US008192071B2

(12) United States Patent
Wright et al.

(10) Patent No.: US 8,192,071 B2
(45) Date of Patent: Jun. 5, 2012

(54) AGITATOR APPARATUS WITH COLLAPSIBLE IMPELLER

(75) Inventors: Robert Wright, Centerport, NY (US); Peter Makowenskyj, New Hyde Park, NY (US); Geneane Walsh, Ronkonkoma, NY (US); Christopher Sullivan, Amityville, NY (US)

(73) Assignee: Sartorius Stedim Biotech GmbH (DE)

( * ) Notice: Subject to any disclaimer, the term of this patent is extended or adjusted under 35 U.S.C. 154(b) by 926 days.

(21) Appl. No.: 12/218,542

(22) Filed: Jul. 16, 2008

(65) Prior Publication Data

US 2010/0014379 A1 Jan. 21, 2010

(51) Int. Cl.
*B01F 7/00* (2006.01)
*B01F 7/18* (2006.01)

(52) U.S. Cl. .... 366/308; 366/285; 366/273; 366/325.93

(58) Field of Classification Search ..... 366/308, 366/273, 325.4, 342–343, 325.93, 285
See application file for complete search history.

(56) References Cited

U.S. PATENT DOCUMENTS

| | | | | |
|---|---|---|---|---|
| 2,805,843 | A * | 9/1957 | Block | 366/343 |
| 2,859,020 | A * | 11/1958 | Eddy et al. | 366/274 |
| 3,207,489 | A * | 9/1965 | Berman | 366/308 |
| 3,559,962 | A * | 2/1971 | Enssle et al. | 366/308 |
| 4,083,653 | A * | 4/1978 | Stiffler | 416/142 |
| 4,176,157 | A * | 11/1979 | George et al. | 422/114 |
| 5,183,336 | A * | 2/1993 | Poltorak et al. | 366/273 |
| 5,366,289 | A * | 11/1994 | Supelak | 366/308 |
| 6,194,199 | B1 * | 2/2001 | Asa | 435/309.1 |
| 6,419,385 | B1 * | 7/2002 | Walls | 366/247 |
| 7,441,940 | B2 * | 10/2008 | Vanek | 366/129 |
| 7,967,497 | B2 * | 6/2011 | Whitney | 366/129 |
| 2004/0213082 | A1 * | 10/2004 | Tobler | 366/325.4 |
| 2004/0223404 | A1 * | 11/2004 | Hughes | 366/191 |
| 2005/0007874 | A1 * | 1/2005 | Roszczenko et al. | 366/270 |
| 2005/0088907 | A1 * | 4/2005 | Vanek | 366/129 |
| 2006/0156526 | A1 * | 7/2006 | Tobler | 29/412 |
| 2009/0135668 | A1 * | 5/2009 | Hamilton | 366/343 |

* cited by examiner

*Primary Examiner* — Joseph Del Sole
*Assistant Examiner* — Nahida Sultana
(74) *Attorney, Agent, or Firm* — Gerald E. Hespos; Michael J. Porco

(57) ABSTRACT

An agitator apparatus for a mixing vessel having a rotating member and one or more impellers coupled to the rotating member, at least one of the impellers being collapsible so that the collapsible impeller is movable from a collapsed orientation to a deployed orientation relative to the rotating member. A limiting member may be used to prevent the collapsible impeller from opening beyond its fully deployed orientation.

20 Claims, 12 Drawing Sheets

AGITATOR APPARATUS WITH COLLAPSIBLE IMPELLER

FIELD OF THE INVENTION

The present invention relates to the field of agitator apparatus having impellers for use in mixing apparatus and, more particularly, to agitator apparatus with a collapsible impeller especially for use within a disposable mixing vessel.

BACKGROUND OF THE INVENTION

Mixing tanks with rotating agitator apparatus are typically used to mix chemical compounds. Frequently, the ingredients being mixed in the agitator tanks require a sterile environment prior to use and/or during use, such as when ingredients are being mixed to prepare a pharmaceutical product. To provide such a sterile environment, mixing vessels must be constructed to prevent contaminants from entering the vessel during the entire batch process, including filling the vessel, mixing the contents and draining the vessel.

Recently, sterile mixing tanks have been developed that utilize a flexible vessel, generally in the form of a plastic bag, as the mixing container. The flexible vessel can be constructed in a sterile environment and sealed prior to use. Flexible vessels may also be constructed, assembled and sealed in non-sterile manufacturing environments such as clean rooms prior to sterilization by gamma irradiation. Such systems, which use a tank support to maintain the integrity of the flexible container when filled, generally are disposed of after use, to obviate the need for cleaning so as to recreate a sterile environment in the vessel quickly between uses and eliminate the possibility of cross contamination.

To assist in maintaining a sterile environment, disposable mixing vessels have been manufactured with the agitator apparatus contained within the sealed vessel when shipped. In these mixing vessels, the agitator apparatus is placed within the vessel prior to sealing and subsequent sterilization by gamma irradiation so as to minimize the potential for breaching the sterile environment. To further reduce the chance of a breach of the sterile environment within the mixing vessel, these mixing vessels often employ magnetic drive means for driving the impellers, thus obviating the need for a physical connection through the vessel wall.

Examples of disposable mixing vessels with internally mounted impellers include U.S. Patent Publication Nos. 2005/0272146, 2006/0131765, 2005/0117449, 2007/0252290 and 2006/0092761. Each of these references describes a mixing vessel designed for a single or limited use with internal agitating apparatus including impellers that are activated by cooperating drive elements associated with a drive means.

The agitator apparatus of the prior art, however, generally use impellers that are formed in fixed relation to the structure on which they reside. As such, the minimum volume that a mixing vessel containing the agitator apparatus can be folded down to for shipping and storage is limited by the volume of space occupied by the agitator apparatus with fixed impellers. Additionally, fixed impellers are known to cause damage to the material of disposable, flexible mixing vessels due to high contact pressure over the small contact area of the impellers when the flexible mixing vessel with the agitator apparatus pre-fitted therein is packaged, shipped and/or stored.

It is therefore an object of the invention to provide a space saving agitator apparatus for a mixing vessel, to aid in the packing, shipping and storage of the agitator apparatus alone or pre-fitted into a flexible mixing vessel, such as a disposable, single use mixing vessel.

It is a further object of the invention to provide an agitator apparatus for a flexible mixing vessel where the impeller is less likely to damage the mixing vessel when the agitator apparatus comes into contact with the material of the mixing vessel.

It is another object of the invention to provide an agitator apparatus for a flexible mixing vessel with larger fins to increase mixing efficiency or permit the mixing of viscous materials without adding to the size of the flexible mixing vessel for packaging, shipping and/or storage.

It is still another object of the present invention to provide an agitator apparatus for a mixing vessel that can be quickly and easily made functional for mixing without breaching the sterile environment of a mixing vessel containing the agitator apparatus.

SUMMARY OF THE INVENTION

These and other objects are achieved by the present invention, which is directed to an agitator apparatus for a mixing vessel comprising at least one rotating member and one or more impellers coupled to the rotating member, at least one of the impellers being collapsible so that the collapsible impeller is movable from a collapsed orientation to a deployed orientation relative to the rotating member. In the collapsed orientation the impeller can rest in less than its fully deployed orientation and most preferably substantially in a plane with other impellers and the rotating member. This minimizes the volume of the agitator apparatus, to aid in the packaging, shipping and storage of an empty mixing vessel containing the agitator apparatus.

The collapsible impeller is preferably automatically deployed after the mixing vessel is filled as the agitator apparatus is rotated by a drive means. In a preferred embodiment, rotation of the agitator apparatus after filling of the mixing vessel creates a force against the collapsed impellers, causing the impellers to be pushed into the deployed orientation. To assist in achieving this automatic deployment, the use of tapered impeller ends that direct the contents to the interior of the impeller is most preferred. Channels that direct fluid forces against the interior of the impellor may also be incorporated into the rotating member to deploy the impellors. Other conceivable means of assisting deployment may also be used, such as hydrodynamic foils or surfaces similar to "wings." The force generated by the contents of the mixing vessel of the contents of the mixing vessel further acts to maintain the impellers in the deployed orientation, regardless of whether the agitator apparatus includes a catch or locking mechanism. Alternatively, a spring or other mechanism can be used to move the impellers into the deployed orientation.

In the preferred embodiment, the one or more collapsible impellers further comprise a limiting member that limits the movement of the impeller to the fully deployed orientation. In this regard, as is understood by a person skilled in the art, an impeller for a mixing vessel will generally perform best with a maximum fixed angle of not greater than 90 degrees, however, the invention is not limited by the angle of the impeller in its fully deployed orientation.

The limiting member can take any form, but is preferably a flexible or folded panel, strap, belt, band, strand or the like that engages both the rotating member and the collapsible impeller to limit the movement of the impeller to a fully deployed orientation. Alternatively, the limiting member can be a stop on the rotating member behind the impeller or on a portion of the impeller that can act against the rotating member to keep the impeller from opening more than is desired by the design.

The limiting member may cooperate with a catch or lock to maintain the impeller in the fully deployed position, however, this is not deemed essential to the invention since, as a matter of design choice, it may be preferred to permit the impellers to be easily moved into the collapsed configuration for disposal of the mixing vessel.

Coupling the collapsible impellers to the rotating member can be achieved by any known means. In the most preferred embodiment, the collapsible impellers are coupled across a hinge that permits that collapsible impeller to pivot between the collapsed orientation and the deployed orientation. The hinge is preferably a living hinge, preferably a flexible or foldable material coupling the impeller to the rotating member, and most preferably a thinned section of the plastic that can also form the impeller and a connecting member for attachment to the rotating member, but can utilize other methods such as but not limited to a pin or detent snap fit components between two cooperating hinge elements to permit the collapsible impeller to achieve its deployed orientation. Although preferred, the coupling of the collapsible impellers to the rotating member does not require a direct attachment, and intermediate members may be included as a matter of design choice.

The materials of the agitator apparatus, including the rotating member and impellers, are also a matter of design choice, however, the use of recyclable plastics is preferred. In this regard, the impellers may be formed integrally with the rotating member, across a living hinge or the like, as described above, by injection molding, machining, casting, etc. Alternatively, the parts may be individually formed and coupled by any known means, including gluing, adhesives, bonding, thermal bonding, radio frequency (RF) bonding, mechanical assembly or combinations of any known method.

The number of collapsible impellers that can be used on an agitator apparatus manufactured in accordance with the present invention is not limited, except by the design of the apparatus itself, including the shape and size of the rotating element.

Stiffening elements can be formed on the impellers to provide additional strength to the impeller when the viscosity of the contents being mixed or speed of rotation of the impellers is a factor. Alternatively, the impeller may be formed with an internal structure that provides increased rigidity or tensile strength.

Although the agitator apparatus of the present invention can be driven by any known means, the use of a magnetic drive system as described in one or more of the above cited prior art references is most preferred. When a magnetic drive system is used, it is contemplated that the magnetic elements associated with the agitator apparatus are formed within the material of the rotating member to minimize the number of elements in contact with the contents of the mixing vessel.

While a sterile system is the preferred assembly it does not preclude use of this invention in non-sterile assemblies or non-enclosed assemblies. In these instances, a disposable assembly may be preferable but sterility or preventing contaminants from entering the assembly is not critical.

BRIEF DESCRIPTION OF THE DRAWINGS

The present invention will be better understood when considered in view of the attached drawings, in which like reference characters indicate like parts. The drawings, however, are presented merely to illustrate the preferred embodiment of the invention without limiting the invention in any manner whatsoever.

DETAILED DESCRIPTION OF THE PREFERRED EMBODIMENT

The agitator apparatus of the present invention is an improvement that can be used in any mixing vessel, due to its compact size for packaging, shipping and storage, as well as its adaptability to utilize larger and greater numbers of impellers. However, it is described here in the environment of a mixing apparatus formed of a flexible mixing vessel designed for disposal after a single use. Since this environment is believed to be best suited for the use of magnetic drive means to turn the agitator apparatus, the present invention is described for use with cooperating magnetic drive elements. Notwithstanding, the present invention is not intended to be limited to these particulars.

Figure 1:
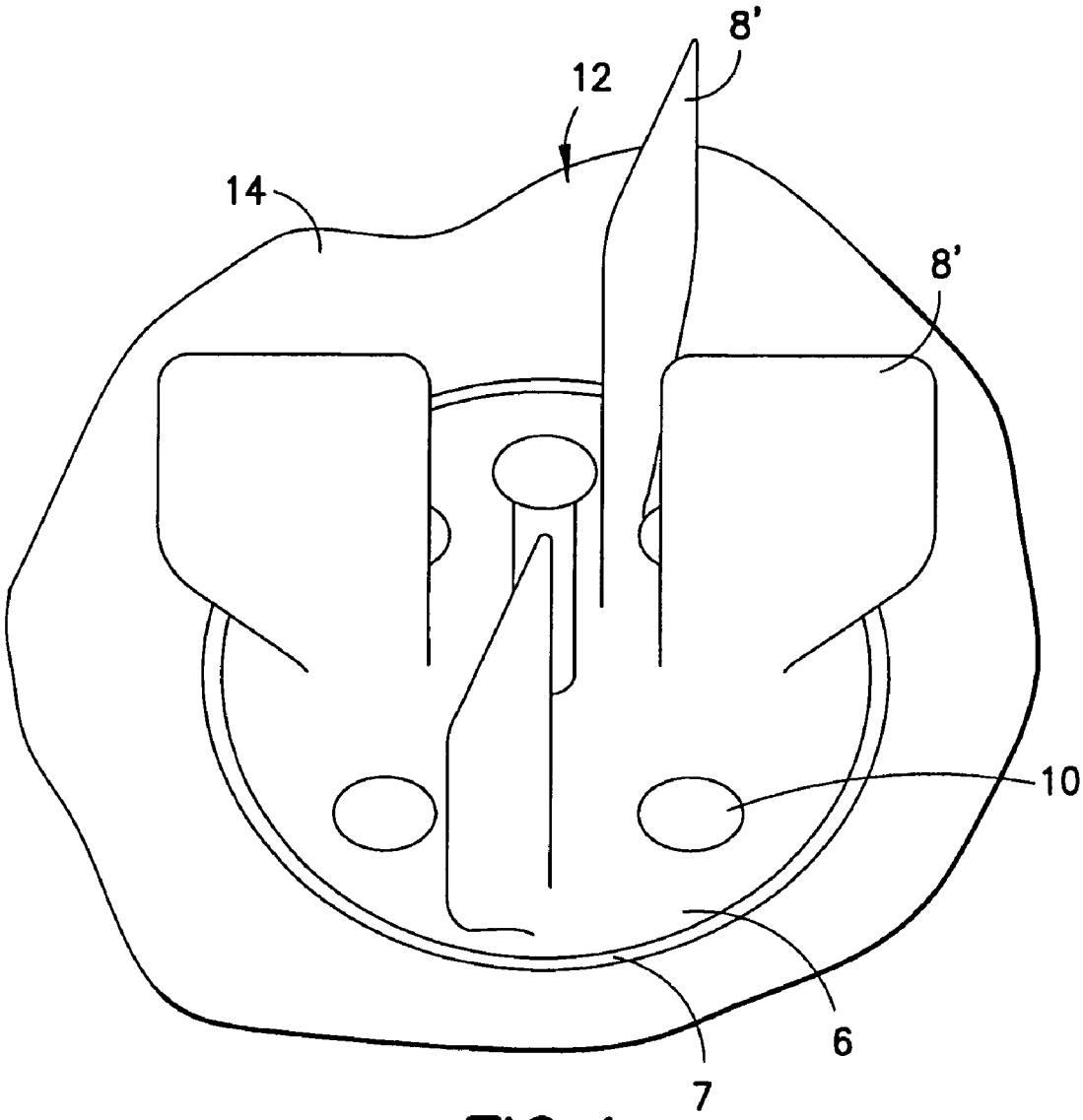
FIG. 1 PRIOR ART
FIG. 1 is a perspective view of a prior art magnet driven agitator apparatus for use in a flexible mixing vessel.

A prior art magnetic drive agitator apparatus 2 for use in a flexible mixing vessel 4 is shown in FIG. 1. The prior art agitator apparatus 2 comprises a rotating member 6 that rotates on a flange 7 of the mixing vessel 4, a number of fixed impellers 8' and magnets 10 that can be engaged by an externally mounted magnetic drive means (not shown). As is well known in the art, after the flexible container 4 is filled with contents to be mixed, the magnetic drive means is placed against the flange 7 of the flexible mixing vessel 4, in alignment with the magnets 10 of the agitator apparatus 2. The rotating magnetic drive means engages the magnets 10 of the agitator apparatus 2 to turn the rotating member 6, which in turn cause the impellers 8' to move through the contents of the mixing vessel 4 to mix the contents.

Since the impellers 8' of the agitator apparatus 2 of FIG. 1 are fixed in relation to the rotating member 6, the entire height, width and length of all of the impellers 8' must be provided for during packaging, shipping and storage. Additionally, due to the fin-like nature of the impellers 8', high pressure and/or abrasion of the material of the flexible mixing vessel 4 against the impellers 8' creates the potential for damage to the material of the flexible mixing vessel 4, leading to possible failure of the mixing vessel 4 during use.

Figure 2A:
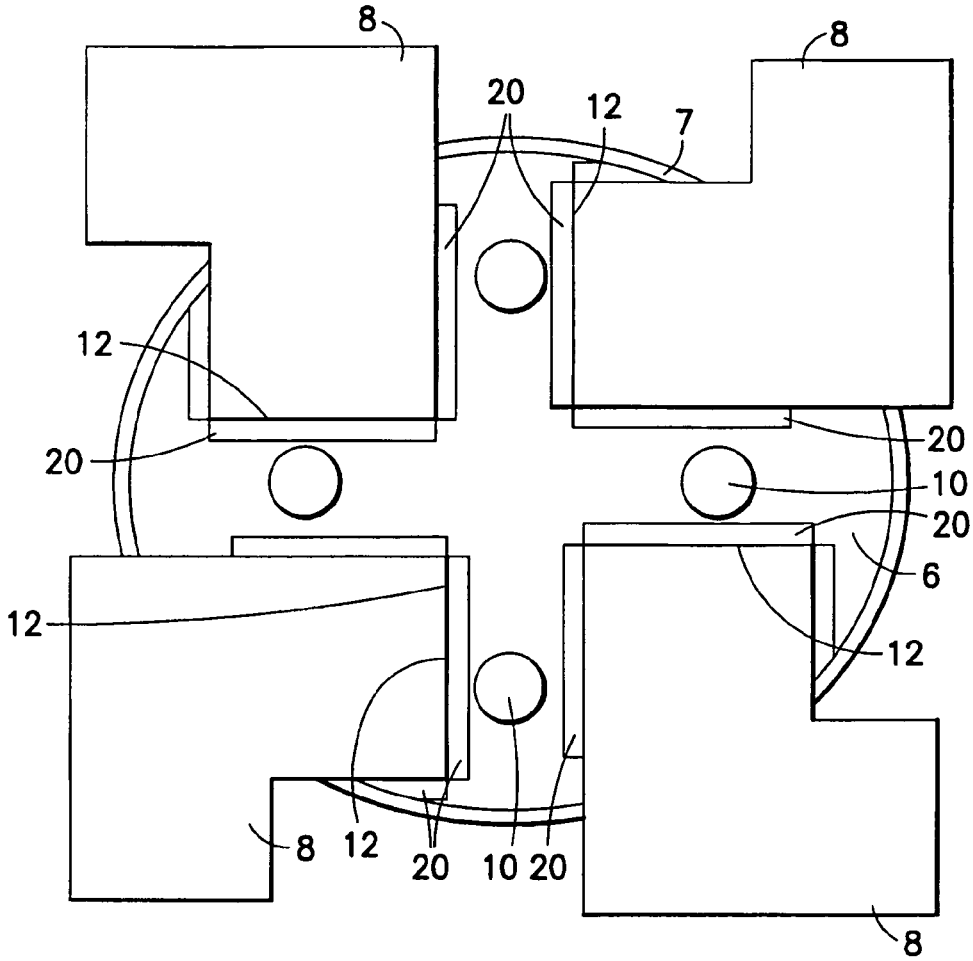
FIG. 2A is a plan view of an agitator apparatus of the present invention with the impellers in a collapsed orientation.
Figure 2B:
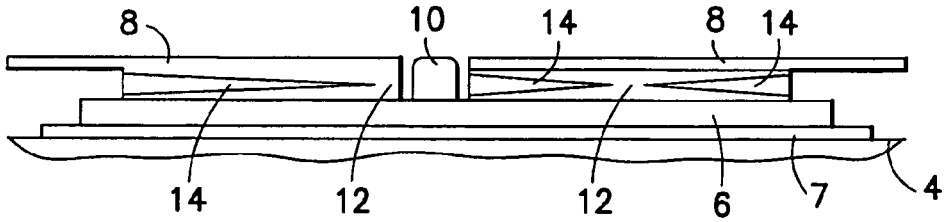
FIG. 2B is an elevational view of the agitator apparatus of the present invention shown in FIG. 2A with the impellers in a collapsed orientation.
Figure 3:
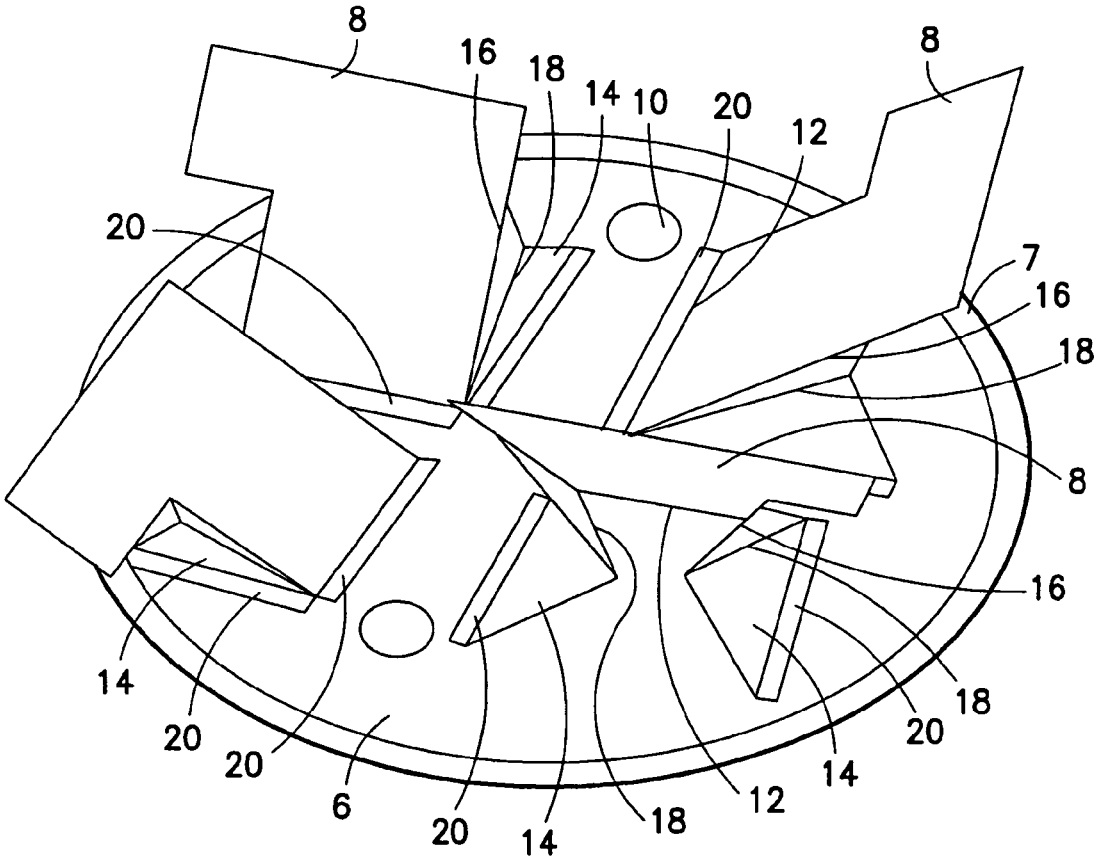
FIG. 3 is a perspective view of the agitator apparatus of the present invention shown in FIG. 2A with the impellers in a partially deployed orientation.
Figure 4:
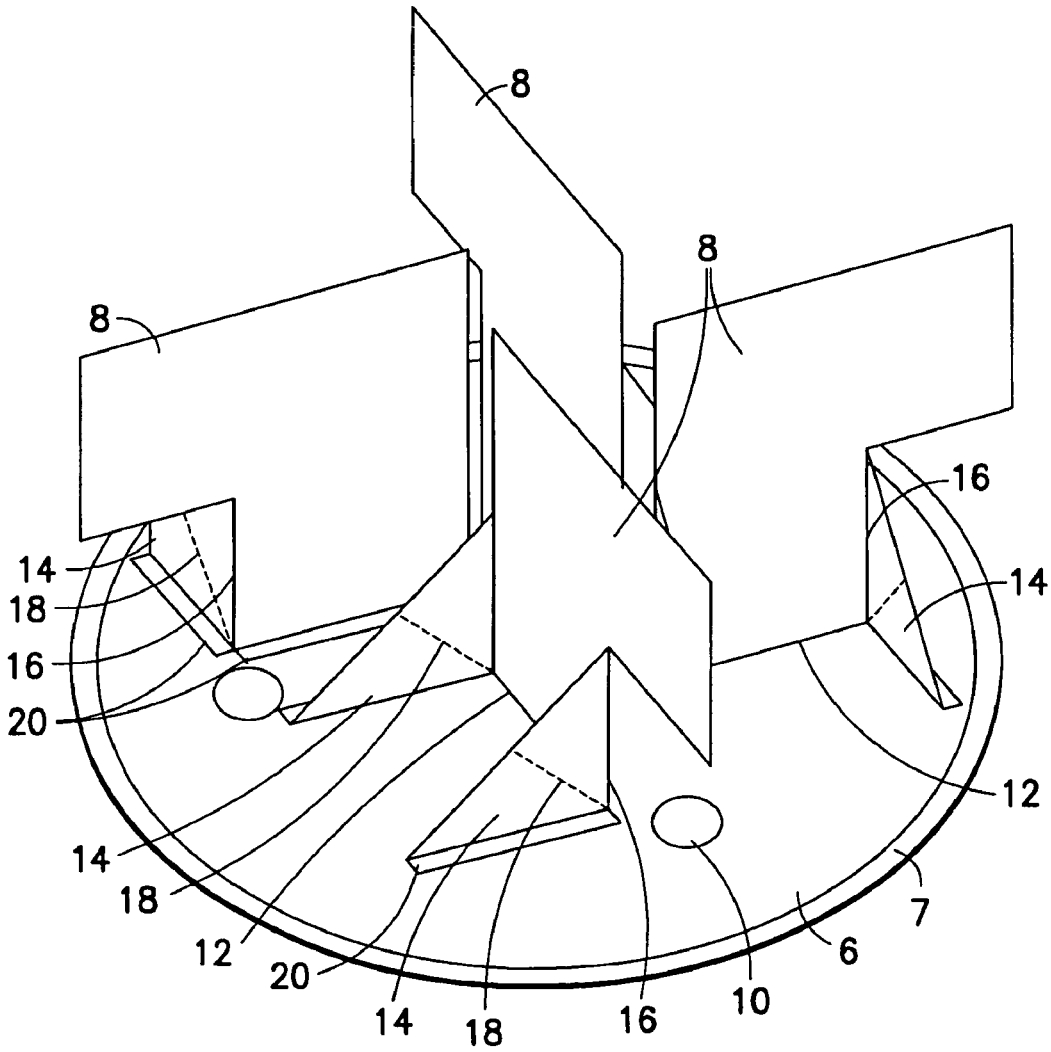
FIG. 4 is a perspective view of the agitator apparatus of the present invention shown in FIG. 2A with the impellers in a fully deployed orientation.

In contrast, the present invention is directed to an agitator apparatus 2 with impellers 8 that are collapsible in relation to the rotating member 6. More particularly, the collapsible impellers 8 coupled to the rotating member 6 are movable relative to the rotating member 6, from a collapsed orientation, as shown in FIGS. 2A and 2B, to a deployed orientation, shown in FIG. 4.

The impellers 8 can be coupled to the rotating member 6 in any manner, however, it is preferred that the impellers 8 be attached to the rotating member 6 across a hinge 12 that permits pivoting of the impeller 8 from the collapsed orientation to the deployed orientation. Although any hinge 12 can be used, the embodiment shown in FIGS. 2A-5C preferably includes a living hinge, formed of a uniform foldable, thinned rigid or other suitable material, to reduce manufacturing costs and potential for contamination of the sterile environment.

Figure 5A:
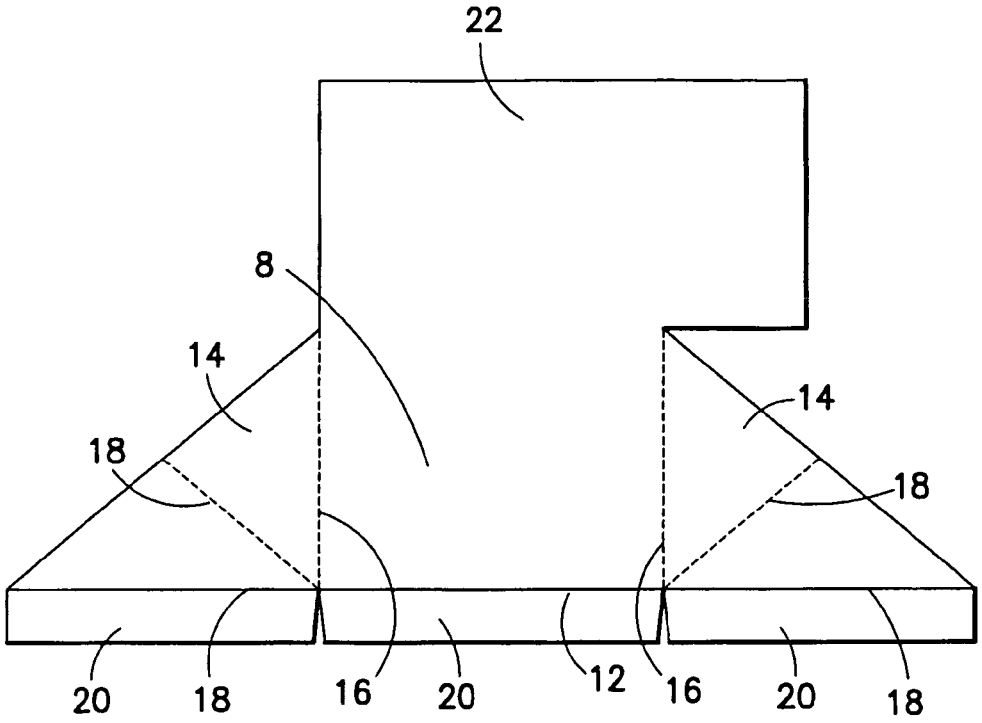
FIG. 5A is a plan view of a suitable impeller design prior to coupling to the rotating member for use in the present invention.
Figure 5B:
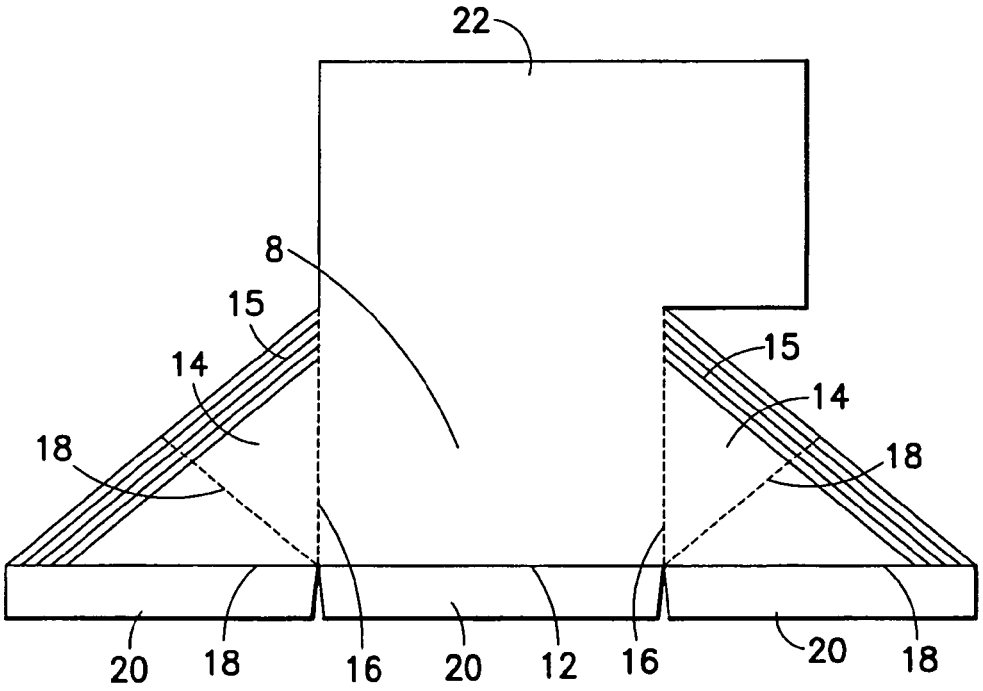
FIG. 5B is a plan view of an alternative impeller design prior to coupling to the rotating member for use in the present invention, including reinforcements to the limiting members.
Figure 5C:
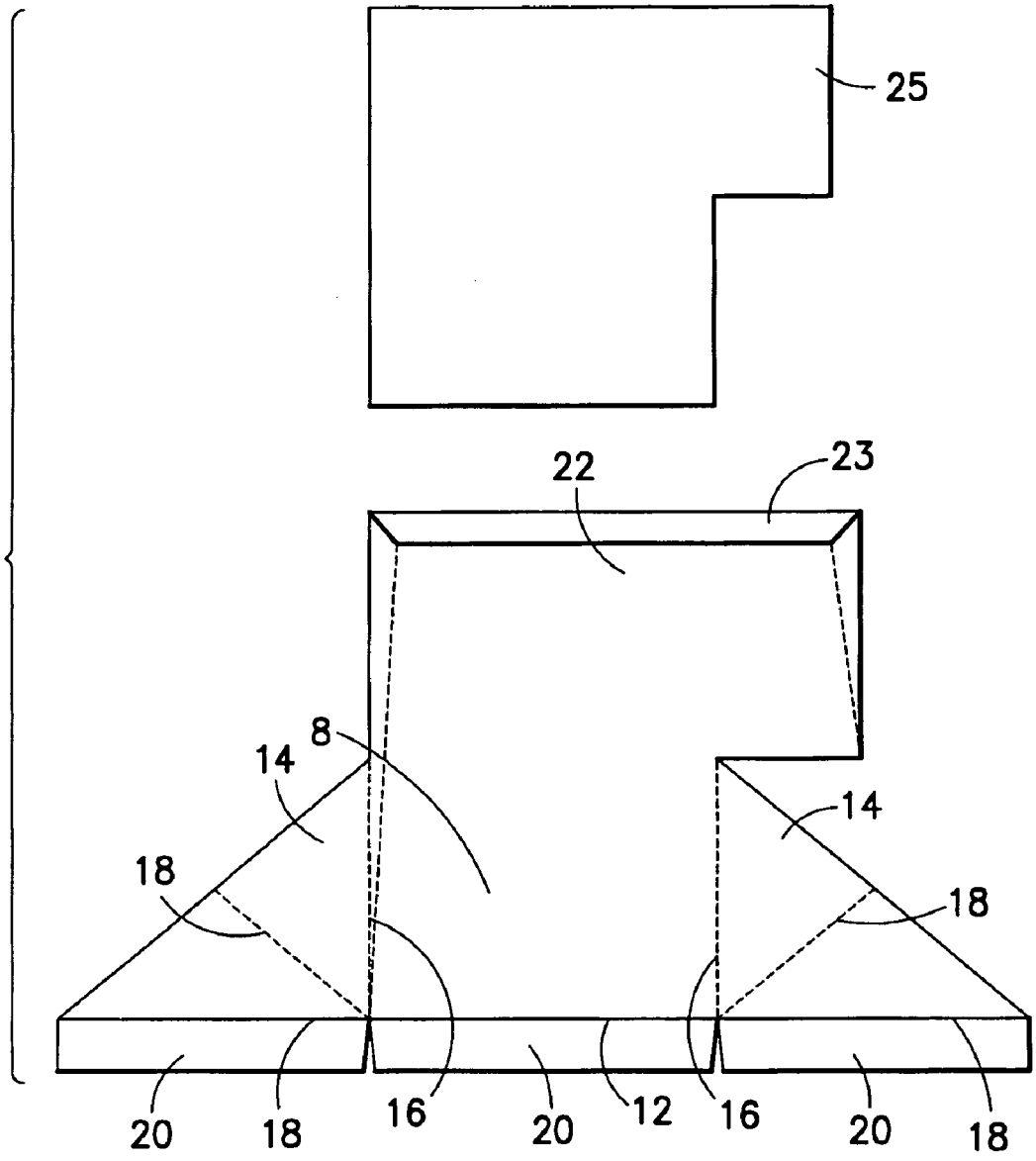
FIG. 5C is a plan view of a suitable impeller design prior to coupling to the rotating member for use in the present invention where the impeller is formed with a pocket or sleeve.
Figure 5D:
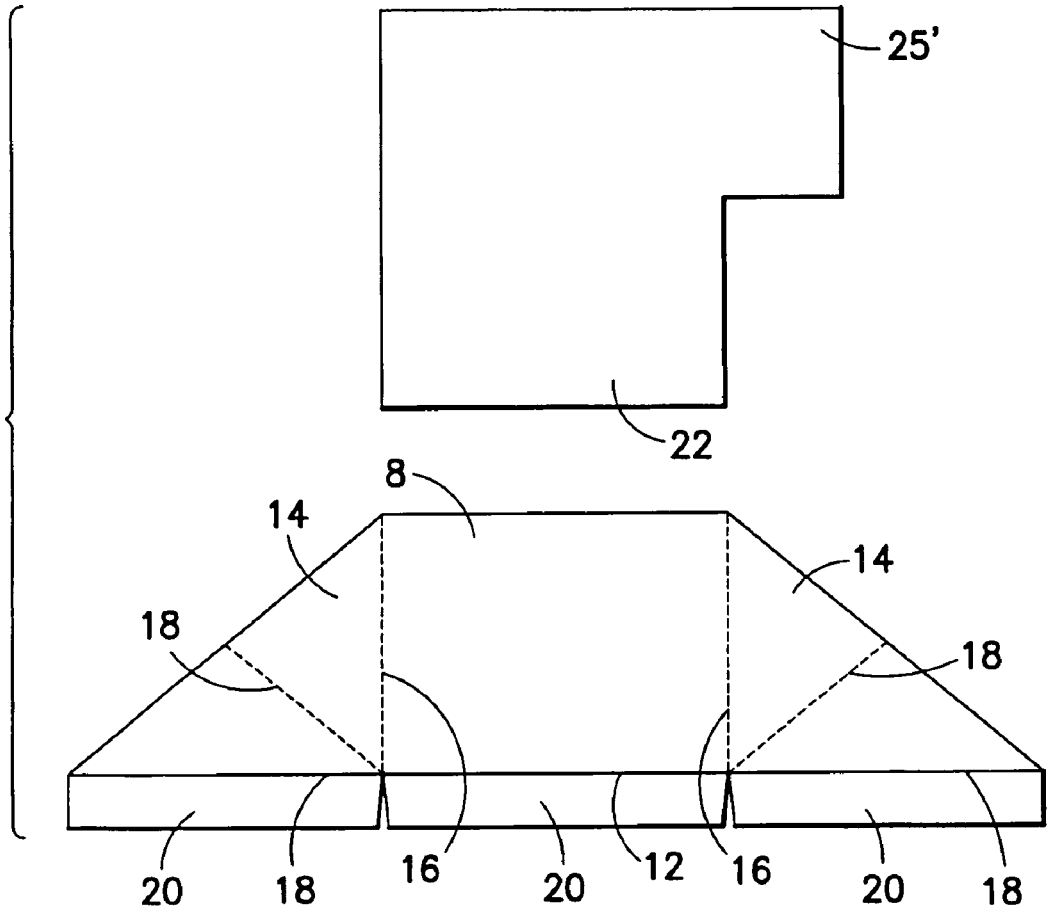
FIG. 5D is an exploded plan view of a suitable impeller design prior to coupling to the rotating member for use in the present invention where the impeller is formed of a foldable material to which a stiff upper section is bonded.
Figure 6A:
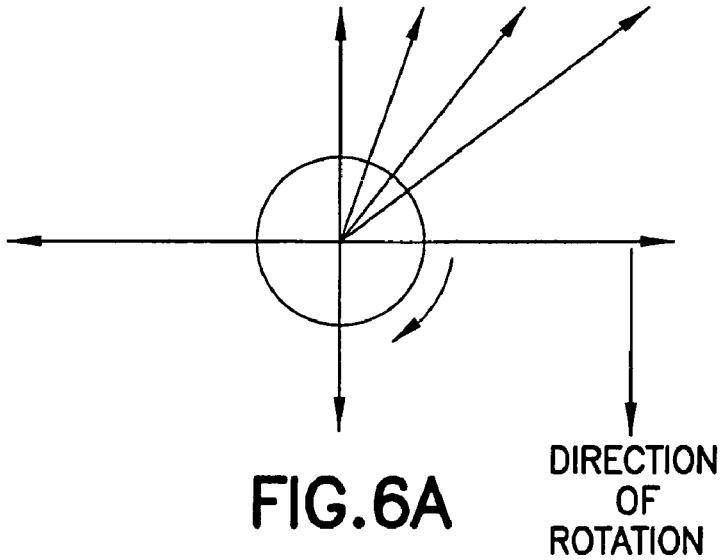
FIG. 6A is a schematic plan of the possible placements of collapsible impellers on a rotating member, also illustrating that the length and width dimensions of the collapsed impellers are not limited by the rotating member, but only by the space available within the mixing vessel.

The agitator apparatus 2 of the present invention also preferably includes a limiting member 14 to limit the deployment angle of the impeller 8 relative to the direction of rotation of the rotating member 6 (see FIG. 6A). The limiting member 14 can also be any suitable member that limits the angle of deployed impeller 8, including a folded panel shown in FIGS. 2B-5C, a stop as shown in FIGS. 7-7C or any like structure.

The impeller 8 can be manufactured integrally with the rotating member 6 by injection molding, machining, casting or the like. Alternatively, the impeller 8 can be manufactured separately from the rotating member 6 for attachment by any known means, including adhesives, bonding, such as by thermal or RF bonding, mechanical assembly of separate parts, as with a conventional hinge having two sections joined by a pin or detents, or a combination of these methods.

With specific respect to the embodiment of FIGS. 2A-5C, the collapsible impeller 8 can be manufactured in a folded configuration for attachment directly to the rotating member 6. FIG. 5A shows the preferred collapsible impeller 8 and limiting members 14 as a cut out of a suitable foldable material. Preferably, the foldable materials include fold lines formed by "coining," or similar processes.

Suitable foldable materials for use in the impeller 8 and/or limiting member 14 include materials composed of one or more layers of the same or even dissimilar materials (composites). Reinforcing material can be incorporated into the layer(s) to provide added strength where needed (see FIG. 5B). The foldable material may incorporate a pocket or sleeve 23 into which a stiff material 25 may be inserted and sealed in order to increase the strength of the impeller 8, as shown in FIG. 5C. The foldable material may also be bonded to a separate piece of stiff material 25' in order to form the impellor 8 (see FIG. 5D).

This embodiment shown in FIGS. 2A-5D includes connecting folds 16 between the impeller 8 and the limiting members 14 as well as deployment folds 18 within the panel of the limiting member 14 that allow the impeller 8 to rise into its deployed orientation.

The collapsible impeller 8 is preferably attached to the rotating member 6 through the use of connector tabs 20, preferably located along the ends of the impeller 8 and the limiting members 14, for attachment to the rotating member 6. The preferred living hinge 12 for deployment of the impeller 8 is preferably located between the impeller 8 and the connection tab 20. Together with deployment folds 18 between the connection tabs 20 and the limiting members 14, the living hinge 12 permits the collapsible impeller 8 to move into the deployed orientation.

The connector tabs 20 of the preferred embodiment of FIGS. 2A-5D may be attached to the rotating member 6 by any suitable means, as set forth above, with adhesives, RF bonding or thermal bonding of the connector tabs 20 to the rotating member 6 being most preferred.

Figure 6B:
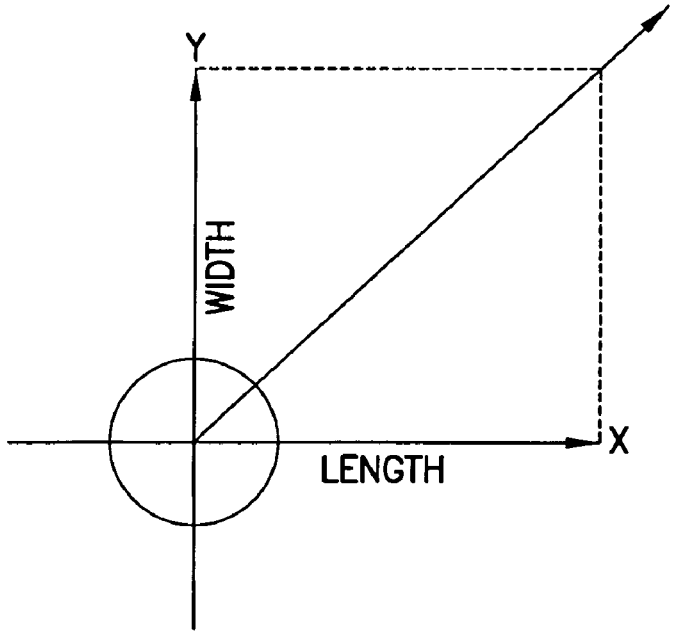
FIG. 6B is a schematic plan of the preferred placements of collapsible impellers on a rotating member.

Any number of impellers 8 can be used with the present invention, limited only by available space on the rotating member 6 and the geometry used (see FIG. 6A). In the preferred embodiment shown in FIGS. 2A-5D, four (4) impellers 8 are set at 90° angles to one another. Although not necessary to the invention, the embodiment of FIGS. 2A-5D show an impeller 8 with an enlarged end portion 22 extending beyond the limiting member 14. The enlarged end portion 22 creates additional surface area to provide for improved mixing of the contents of the mixing vessel 4. The size of the impellers 8, however, can be virtually any size, limited only by the space available within the mixing vessel 4 (see FIG. 6B).

The preferred embodiment of the invention provides for automatic or self opening of the impellers 8 upon rotation through the contents of the mixing vessel 4. When the mixing vessel 4 is filled with the contents to be mixed, and the rotating member 6 begins to turn, the build up of fluid pressure on the interior surfaces of the impellers 8 causes the impellers 8 to deploy. To assist in the deployment of the impellers 8, it is preferred that the terminal ends of the impellers 8 have a tapered interior cross section, to direct the flow of the contents under the impeller 8, see generally FIG. 7A. Channels 30, formed as a conduit 30', a cut away 30" or other structure that directs fluid forces against the interior of the impeller 8, may also be incorporated into the rotating member 6 to help deploy the impellers 8 (see FIGS. 7B and 7C). Other devices may also be incorporated into the impeller 8 itself, alone or in combination with structures incorporated into the rotating member 6, to capture fluid pressure and assist with deployment, for example the use of a foil shaped impeller 8" (see FIG. 7B).

Figure 7A:
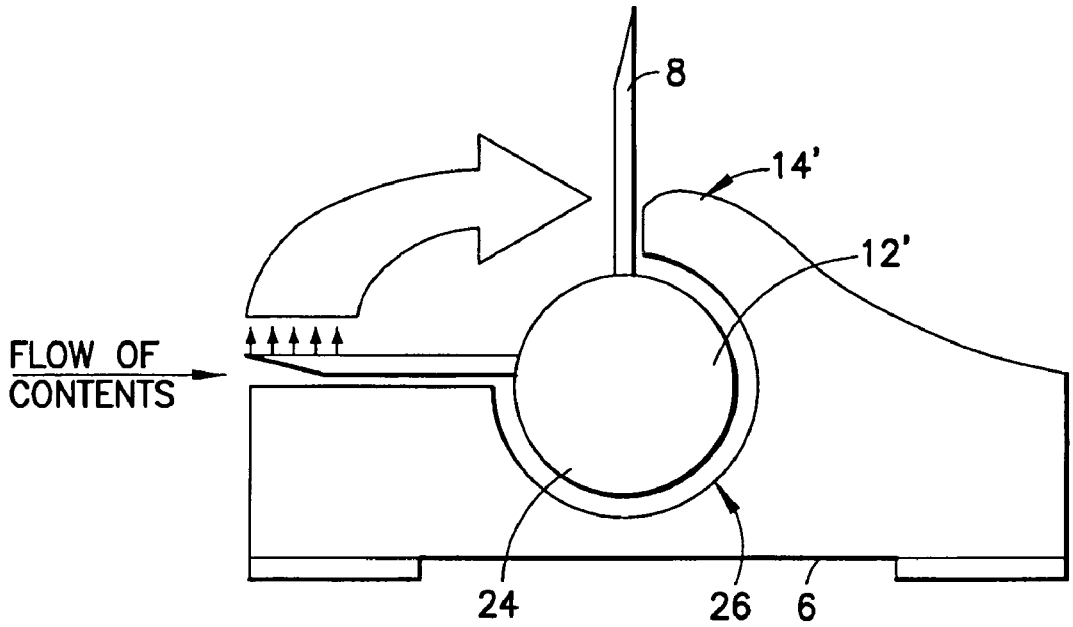
FIG. 7A is a cross sectional elevation of an alternative embodiment of agitator apparatus including a collapsible impeller according to the present invention.
Figure 7B:
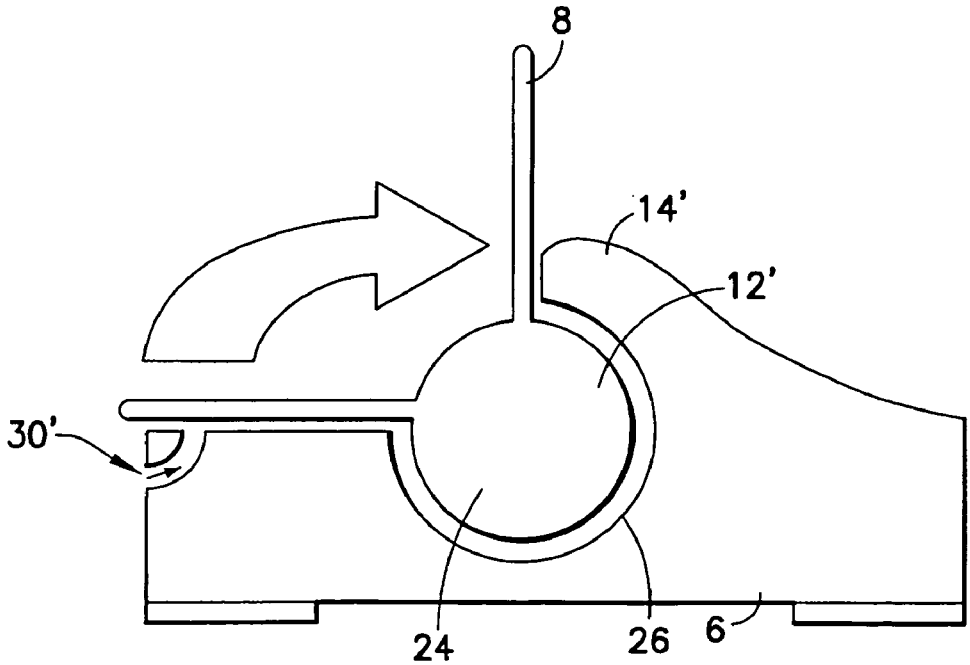
FIG. 7B is a cross sectional elevation of an alternative embodiment of an agitator apparatus including a collapsible impeller according to the present invention with a conduit channel to assist in deployment of the collapsible impeller.
Figure 7C:
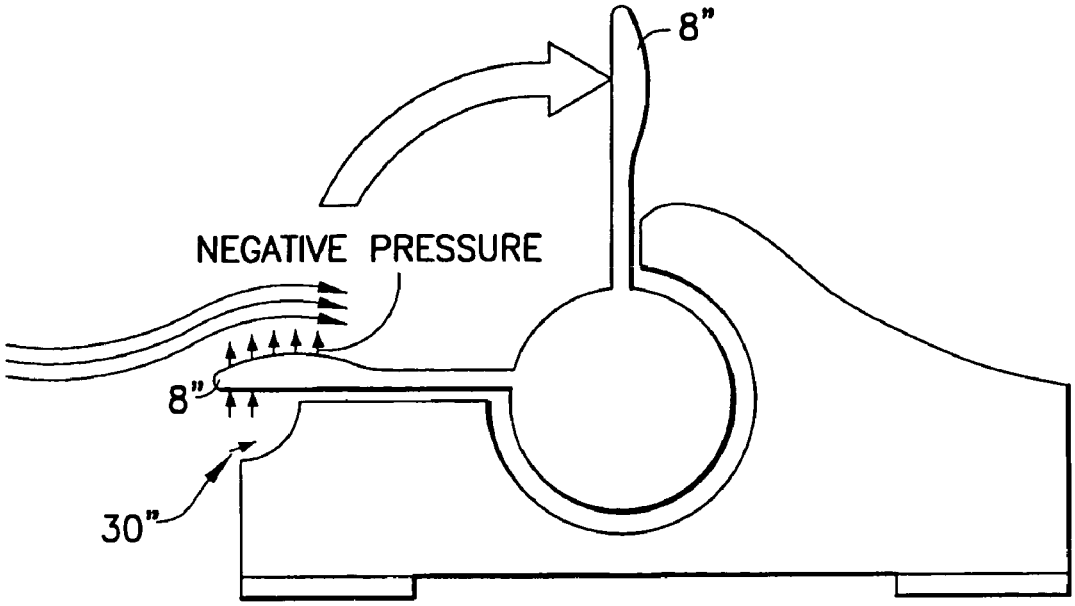
FIG. 7C is a cross sectional elevation of another alternative embodiment of an agitator apparatus including a collapsible impeller according to the present invention with a foil shaped impeller and a cut away channel to assist in deployment of the collapsible impeller.
Figure 7D:
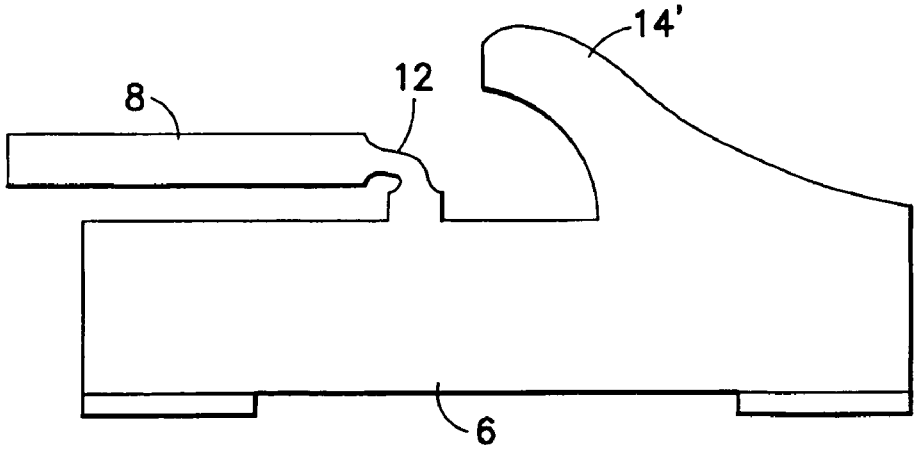
FIG. 7D is a cross sectional elevation of an embodiment of an agitator apparatus including a thinned material living hinge between the rotating member and the collapsible impeller in its collapsed orientation.

An alternative hinge 12' configuration is illustrated in FIGS. 7A-7C, namely, a pin or detent type hinge arrangement where the impeller 8 is mounted on an interior circular body 24 that pivots in an external circular opening 26. Upon application of a force, be it the force of the liquid against the impeller 8, as shown in FIG. 7, a spring force or another deployment force, the interior circular body 24 having the impeller 8 mounted thereon pivots within the exterior circular body 26 and the impeller 8 is deployed.

FIG. 7 also illustrates an alternative limiting member 14' in the form of a stop against which the impeller 8 rests when in the deployed orientation. Although this limiting member 14' is shown with an alternative hinge 12', it is understood that this limiting member 14' can be used with other hinge elements, including the living hinge shown in the embodiment of FIGS. 2A-5D, as shown in FIGS. 7D and 7E with the impeller 8 in its collapsed and deployed orientations, respectively. Moreover, it is understood that the stop limiting member 14 can be set on the exterior surface of the impeller 8, instead of or in addition to placement on the rotating member 6, to limit movement when it meets the top of the rotating member 6.

Figure 8:
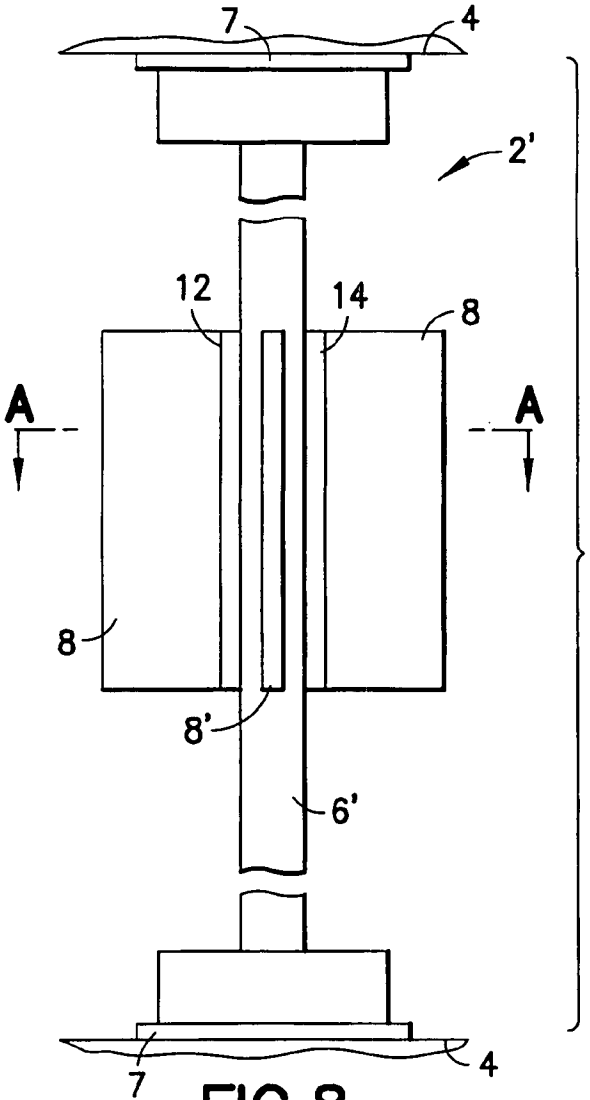
FIG. 8 is an elevational view of a vertical rotating member employing the present invention with the impellers in a deployed position.
Figure 7E:
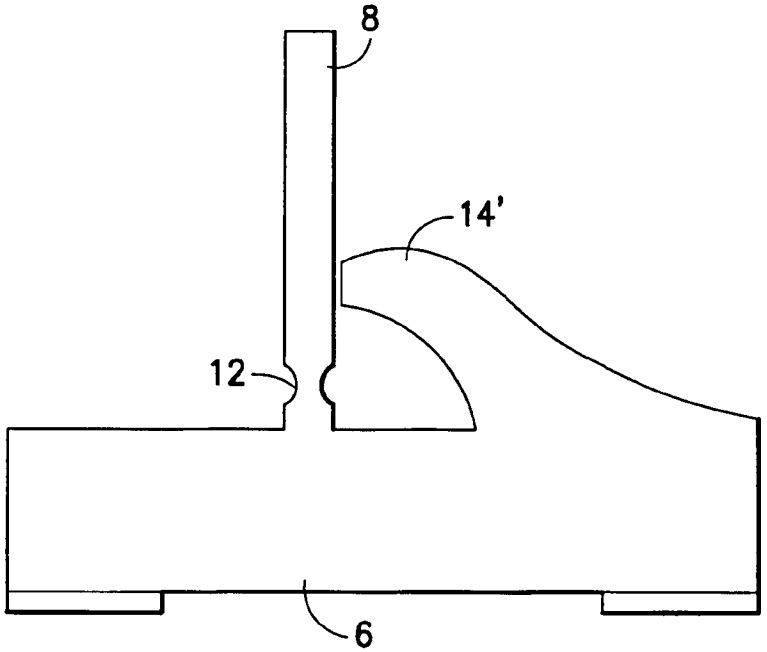
FIG. 7E is a cross sectional elevation of an embodiment of an agitator apparatus including a thinned material living hinge between the rotating member and the collapsible impeller in its deployed orientation.
Figure 10:
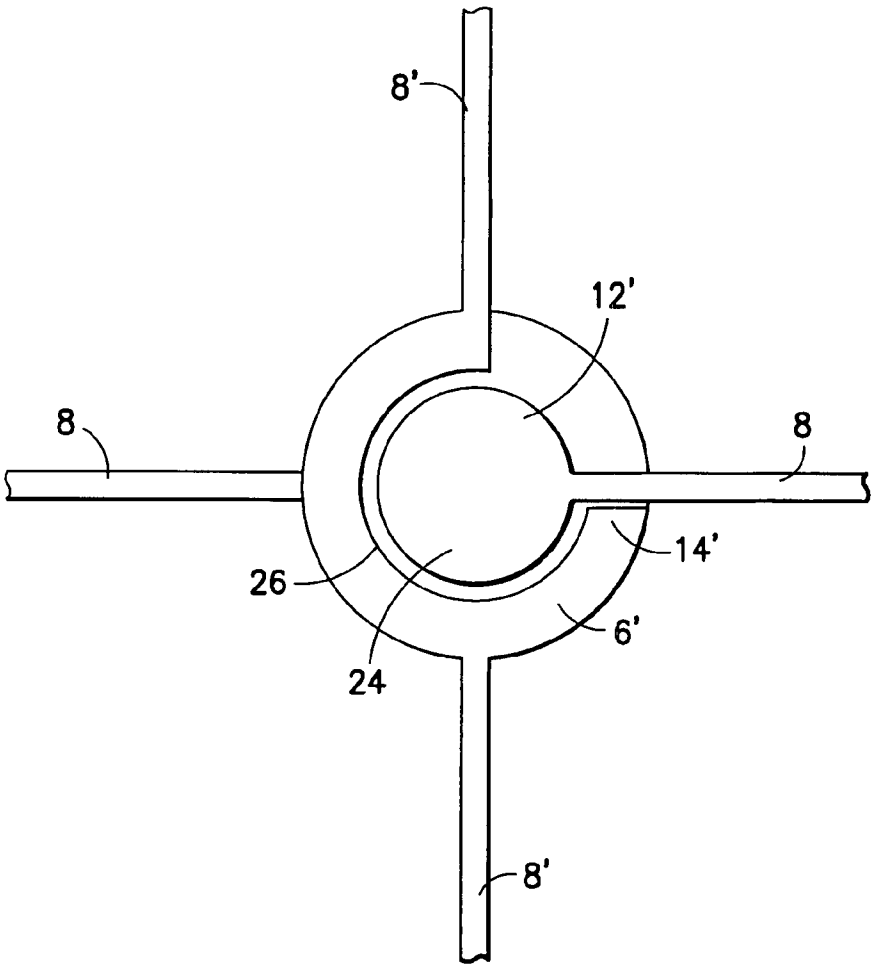
FIG. 10 is a cross sectional view of an alternative embodiment of the present invention shown in FIG. 8, through line A-A.
Figure 9:
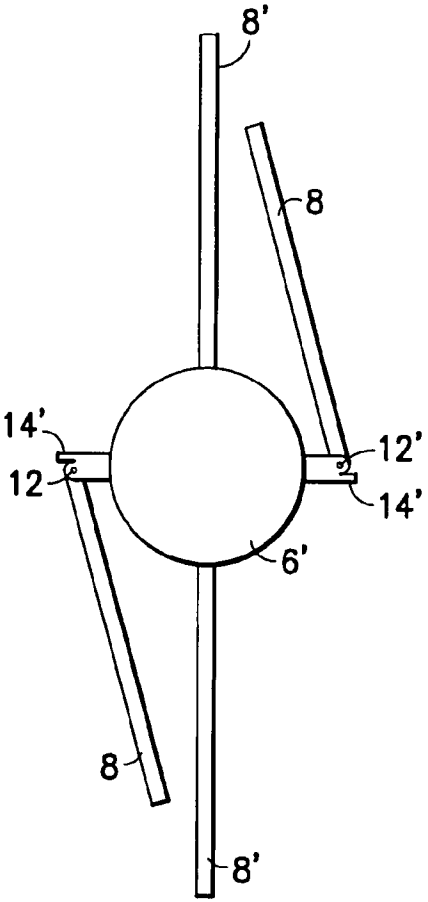
FIG. 9 is a cross sectional view of a first embodiment of the present invention shown in FIG. 8, through line A-A.

The present invention including agitator apparatus 2 having one or more collapsible impellers 8 may also be adapted for use on a vertical rotating member 6', as shown in FIG. 8. In this embodiment, the vertical rotating member 6' includes fixed impellers 8' as well as collapsible impellers 8 that can be collapsed substantially into the plane of the fixed impellers 8'. As shown in FIGS. 9 and 10, there are various ways in which the collapsible impellers 8 can be coupled to the rotating member 6' and moved in relation thereto, and the particular means is not essential to the invention.

For example, FIG. 9 is a cross sectional view taken through line A-A of FIG. 8, showing an embodiment with a pin type hinge 12' and a stop type limiting member 12' where the collapsible impellers 8 collapse substantially to the plane of the fixed impellers 8'. Of course, living hinges or other collapsing means can be used with this embodiment. Similarly, other limiting members 14 can be used to maintain the collapsible impellers 8 in their deployed orientation.

Similarly, FIG. 10 illustrates an alternative arrangement for an agitator apparatus 2' having a vertical rotating member 6'. This embodiment utilizes a pin or detent type hinge arrangement where the impeller 8 is mounted on an interior circular body 24 that pivots in an external circular opening 26. Upon application of a force, be it the force of the liquid against the impeller 8, a spring force or another deployment force, the interior circular body 24 pivots within the exterior circular body 26 and the impeller 8 is deployed.

It is understood that the agitator apparatus 2 with collapsible impellers 8 are intended for use with any suitable mixing apparatus, including mixing vessels having known additional elements such as spargers, inlets, drain ports, monitoring sensors, sampling lines, etc., and that the other elements of the mixing apparatus are not essential to the present invention.

Variations, modifications and alterations to the preferred embodiment of the present invention described above will make themselves apparent to those skilled in the art. All such changes are intended to fall within the spirit and scope of the present invention, limited solely by the appended claims. All prior art referred to herein is hereby incorporated by reference.

The invention claimed is:

1. An agitator apparatus for a mixing vessel comprising a rotating member that is rotatable about a rotational axis and one or more impellers coupled to the rotating member, at least one of the impellers being collapsible so that the collapsible impeller is movable from a collapsed orientation where the collapsible impeller lies substantially in a plane that is substantially perpendicular to the rotational axis when the rotating member is not rotating to a deployed orientation relative to the rotating member where the collapsible impeller extends from the plane that is substantially perpendicular to the rotational axis when the rotating member is rotating.

2. The agitator apparatus of claim 1 further comprising a hinge between the rotating member and the collapsible impeller providing a pivot for moving the collapsible impeller from its collapsed orientation to its deployed orientation.

3. The agitator apparatus of claim 2 wherein the hinge is taken from the group consisting of a living hinge, a pin type hinge and a detent snap fit hinge.

4. The agitator apparatus of claim 3 wherein the hinge is a living hinge.

5. The agitator apparatus of claim 1 further comprising a limiting member.

6. The agitator apparatus of claim 5 wherein the limiting member is taken from the group consisting of a foldable panel, a strap, a band and a strand, having a first end and a second end, the first end being fixed to the collapsible impeller and the second end being fixed to the rotating member.

7. The agitator apparatus of claim 5 wherein the limiting member is a stop that contacts at least a portion of one of the collapsible impeller and the rotating member when the collapsible impeller is in its deployed orientation.

8. The agitator apparatus of claim 1 where the collapsible impeller is configured to be deployed in response to forces generated by rotating the rotating member about the rotational axis.

9. The agitator apparatus of claim 8 wherein the collapsible impeller has an interior tapered cross section for directing a flow of contents within the mixing vessel under the collapsible impeller to force the collapsible impeller into the deployed orientation.

10. The agitator apparatus of claim 8 wherein the collapsible impeller has a foil shaped cross section for creating negative press of fluid contents within the mixing vessel above the collapsible impeller to force the collapsible impeller into the deployed orientation.

11. The agitator apparatus of claim 8 wherein the collapsible impeller is deployed by a spring force.

12. The agitator apparatus of claim 8 further comprising a channel on the rotating member to direct a flow of contents within the mixing vessel under the collapsible impeller to force the collapsible impeller into the deployed orientation.

13. The agitator apparatus of claim 1 further comprising magnets in the rotating member.

14. The agitator apparatus of claim 1 wherein the rotating member and the impellers are formed of plastic.

15. A mixing apparatus comprising a flexible mixing vessel having an integral flange for receiving an agitator apparatus, said agitator apparatus comprising a rotating member that is rotatable about a rotational axis and one or more impellers coupled to the rotating member, at least one of the impellers being collapsible so that the collapsible impeller is movable from a collapsed orientation where the collapsible impeller lies substantially in a plane that is substantially perpendicular to the rotational axis when the rotating member is not rotating to a deployed orientation relative to the rotating member where the collapsible impeller extends from the plane that is substantially perpendicular to the rotational axis rotating member is rotating.

16. An agitator apparatus for a mixing vessel comprising:

a rotating member that is rotatable about a rotational axis, the rotating member having at least one surface extending out from the rotational axis and aligned to intersect the rotational axis; and impellers coupled respectively to the rotating member along hinges extending substantially along the surface of the rotating member that extends out from the rotational axis, the impellers being hinged to move about the hinges relative to the rotating member from collapsed orientations where the impellers lie substantially parallel to the surface of the rotating member that extends out from the rotational axis when the rotating member is not rotating to a deployed orientation where the impellers extend angularly from the surface of the rotating member that extends out from the rotational axis when the rotating member is rotating.

17. The agitator apparatus of claim 16 further comprising a limiting members for limiting hinged movement of the impellers.

18. The agitator apparatus of claim 17 wherein the limiting members are taken from the group consisting of a foldable panel, a strap, a band and a strand, having a first end and a second end, the first end being fixed to the collapsible impeller and the second end being fixed to the rotating member.

19. The agitator apparatus of claim 17 wherein the limiting members are stops that contact at least a portion of the respective impeller and the rotating member when the respective impeller is in its deployed orientation.

20. The apparatus of claim 17 wherein the hinges are aligned substantially normal to the rotational axis of the rotating member.

* * * * *